United States Patent [19]

Aagaard

[11] 4,423,985

[45] Jan. 3, 1984

[54] TENSION LEG PLATFORM WITH HORIZONTAL MOVEMENT CAPABILITY

[75] Inventor: Paul M. Aagaard, Fullerton, Calif.

[73] Assignee: Chevron Research Company, San Francisco, Calif.

[21] Appl. No.: 301,665

[22] Filed: Sep. 14, 1981

[51] Int. Cl.[3] ..... B63B 35/44

[52] U.S. Cl. ..... 405/224; 114/265; 405/195; 405/203

[58] Field of Search ..... 405/195–200, 405/224, 203–208; 114/264, 265; 166/350, 367, 359

[56] References Cited

U.S. PATENT DOCUMENTS

| | | | |
|---|---|---|---|
| 2,399,656 | 5/1946 | Armstrong | 114/265 |
| 3,777,688 | 12/1973 | Melhose | 175/7 X |
| 3,955,521 | 5/1976 | Mott | 114/265 |
| 3,983,706 | 10/1976 | Kalinowski | 405/224 |

FOREIGN PATENT DOCUMENTS

| | | | |
|---|---|---|---|
| 2018871 | 10/1979 | United Kingdom | 405/224 |

*Primary Examiner*—Dennis L. Taylor

*Attorney, Agent, or Firm*—D. A. Newell; E. J. Keeling

[57] ABSTRACT

A tension leg drilling platform of the type having a floating buoyant structure anchored to the sea floor by a plurality of vertical tendons is improved by the addition of flexbile extendable lines between the platform buoyant structure and the tendons to permit movement in the horizontal plane.

8 Claims, 5 Drawing Figures

TENSION LEG PLATFORM WITH HORIZONTAL MOVEMENT CAPABILITY

FIELD OF THE INVENTION

The present invention relates to offshore structures for drilling and producing operations. In particular, the present invention is concerned with an improved tension leg platform having the capability of quickly moving from the path of an oncoming floating obstruction, such as an iceberg, and returning to the original site after the obstruction has passed with a minimum of down time.

DESCRIPTION OF THE PRIOR ART

The use of offshore structures for drilling and producing operations has become relatively commonplace in recent years. However, as more petroleum fields are being developed in deeper waters, the search continues for structures capable of withstanding the hostile wind and wave forces encountered without being prohibitive in cost.

One structure proposed in the prior art which appears promising is the tension leg platform. In a tension leg platform, a large buoyant drilling or producing structure is held in place by vertical mooring lines, or tendons, extending downwardly from the structure to anchors embedded in the sea floor. In order to provide resistance to horizontal as well as vertical movement, the structure is given excess buoyancy.

In certain offshore areas, such as Greenland, the waters are often infested with large icebergs that move with the ocean currents and wind. These areas require that the drilling or producing activities cease during the threat of a collision and the structure moved to prevent total loss of the unit. Such action is, of course, expensive due to the resulting down time.

It is therefore an object of the present invention to present a novel means and method for the rapid removal of a tension leg platform from the original anchor site and the restoration of same once the threat has passed.

SUMMARY OF THE INVENTION

The present invention presents an improved tension leg drilling platform having a floating buoyant structure anchored to the sea floor by a plurality of flexible tendons. Means are provided for connecting flexible lines and adjusting the length thereof between the structure and the anchored tendons. This permits the structure to move substantially in a horizontal plane from the original anchor site within the scope of the flexible lines.

In a preferred embodiment of the invention, means are provided for disconnectably connecting the permanent flexible tendons to the bottom of the buoyant chamber legs. A plurality of flexible lines, stored in reels on the platform deck, pass vertically through a conduit housed in each buoyant chamber leg to the upper end of the flexible tendons. The anchored tendons are disconnected from the buoyant legs and the flexible lines are payed out, permitting the structure to be moved in a horizontal plane from its normal operating position.

DESCRIPTION OF THE PREFERRED EMBODIMENTS

Figures 1, 2, 3, 4:
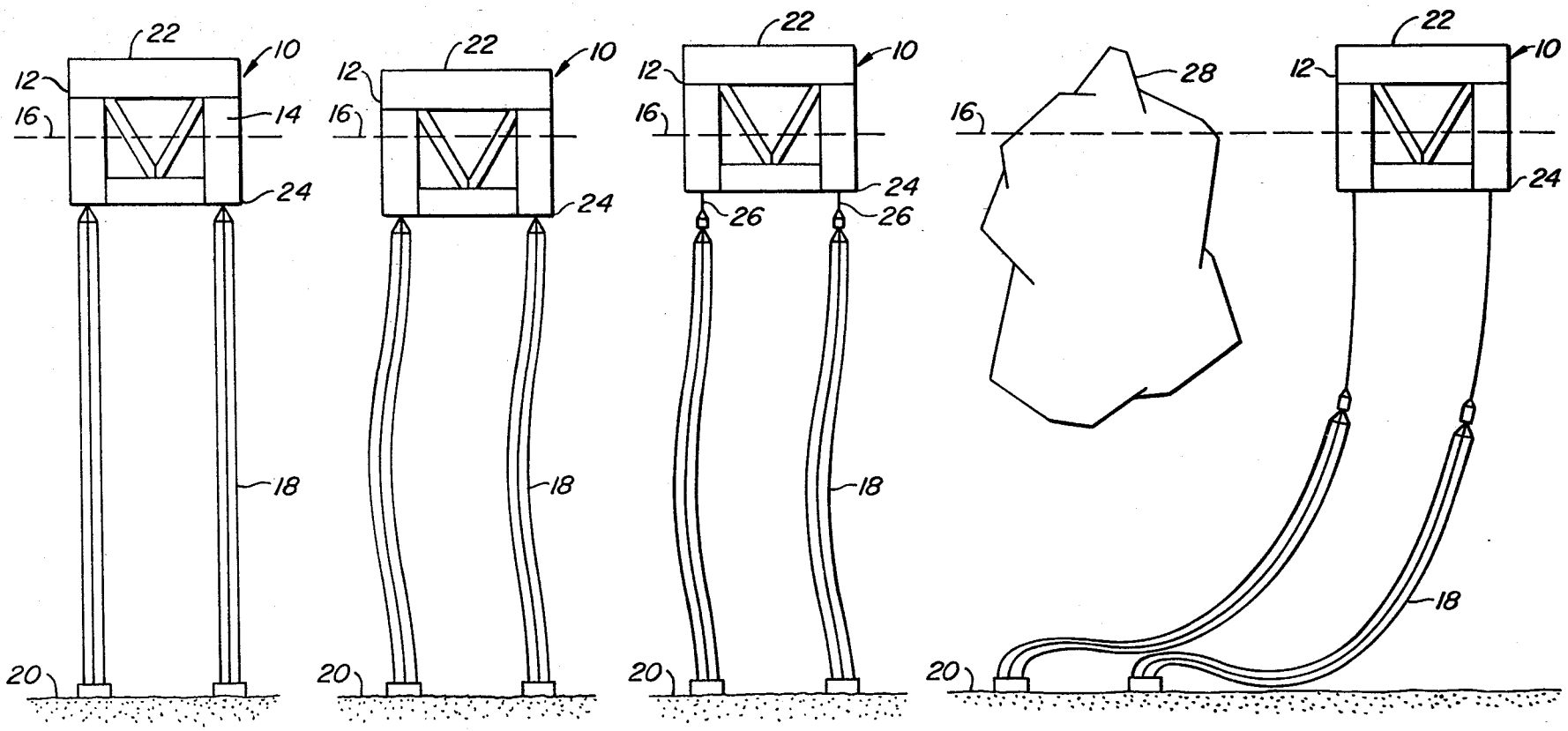
FIG. 1 is a pictorial representation of a tension leg platform in place over a drilling or production site.
FIG. 2 is a pictorial representation of the tension leg platform of FIG. 1 under reduced tension.
FIG. 3 is a pictorial representation of the tension leg platform of FIGS. 1 and 2 at the commencement of extension of the flexible lines.
FIG. 4 is a pictorial representation of the tension leg platform displaced from the path of an oncoming iceberg.

Referring now to FIG. 1 in the drawings, there is shown a tension leg platform, referred to generally by reference numeral 10. The platform broadly comprises a structure 12 having excess buoyancy. The excessive buoyancy of the structure is counter-balanced by mooring lines, or tendons 18, attached to the bottom of the buoyant legs 24 and suitably anchored in the sea floor 20. The tendons are attached to ball or universal joints at the point of attachment to the anchors to allow angular rotation. The upper surface 22 of the structure provides a conventional deck from which drilling or producing operations may be conducted.

In the event of a threatening iceberg, water is admitted to the lower buoyant legs 24 to balance the structure and relieve tension in the mooring lines 18 as shown in FIG. 2. After the tension is relieved, flexible lines 26 connected between the structure and tendons 18 are gradually payed out, permitting the structure to be moved from the path of iceberg 28 as shown in FIG. 4. After the iceberg has passed, lines 26 are used to draw the tendons back to the structure and drilling and producing operations may be continued. Flexible lines 26 are preferably comprised of steel cable which is stored on spools or reels on the platform deck as hereinafter described. The cable used need only be sufficiently strong to safety withstand the force required to raise the tendons in the water from the position shown in FIG. 4 and thus will normally be much smaller than the tendons.

Figure 5:
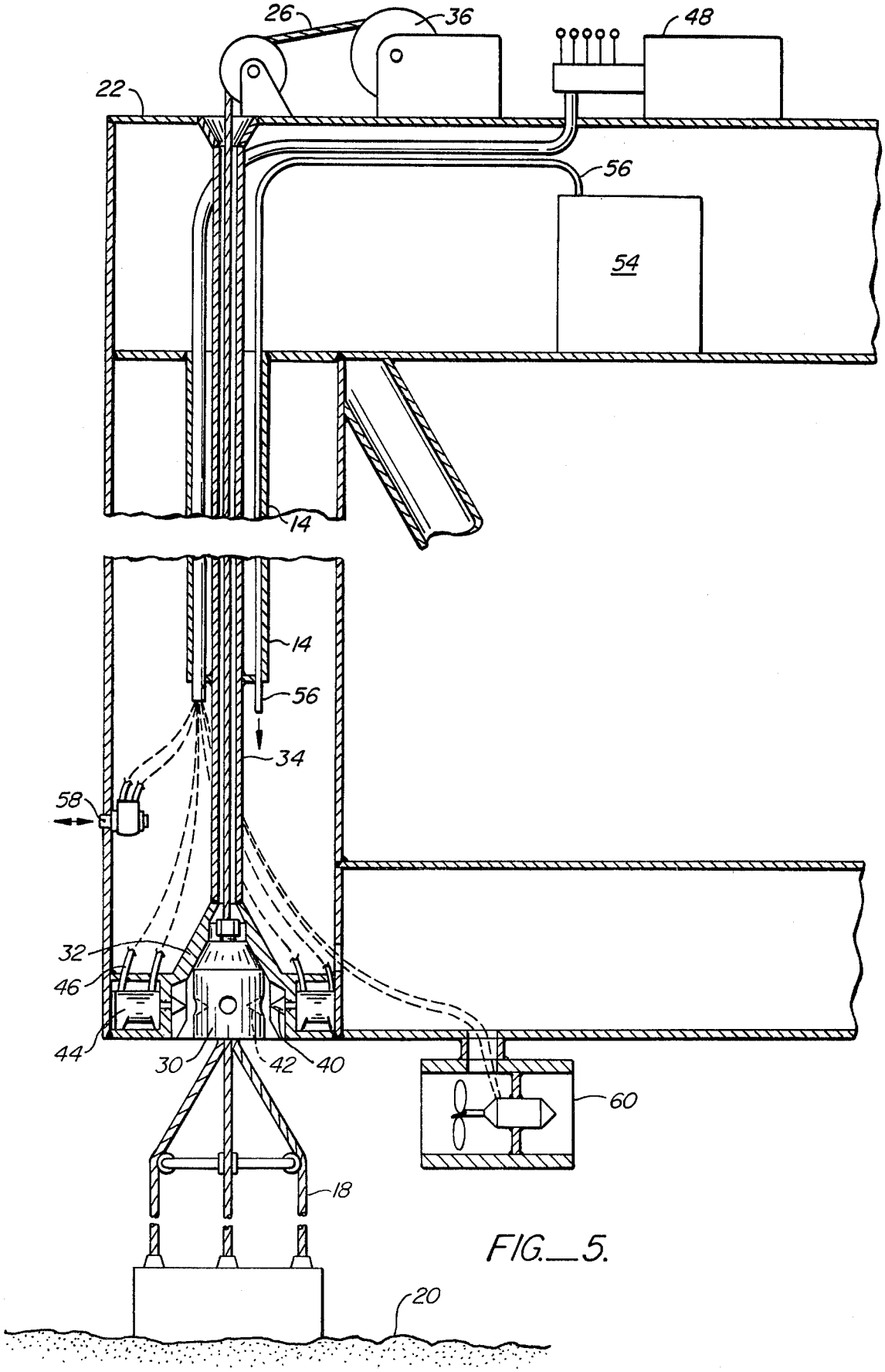
FIG. 5 is a view, partly in cross-section, of apparatus suitable for practicing the present invention.

Referring now to FIG. 5, there is shown a view, partly in cross-section, of apparatus suitable for carrying out the present invention. Identical reference numerals are used to refer to the corresponding elements of the previous figures, where possible, for clarity. The upper ends of tendons 18 are permanently affixed to and terminate in a male plug 30. A female housing 32 is provided at the bottom of buoyant chamber 24 for closely receiving plug 30.

As shown in the drawing, flexible line 26, which is preferably a steel cable, is securely connected to the upper end of plug 30 and passes upwardly therefrom through a sealed conduit 34 to a winch-operated storage reel 36 on the platform deck. Conduit 34 is located within the interior of buoyant chamber leg 24 to provide a substantially vertical passage for the line from the platform deck to female housing 32. The conduit thus serves as a convenient guide for line 26 in drawing plug 30 into female housing 32 by retraction of the line. Preferably, plug 30 and housing 32 are complementary shaped to assure seating of the plug within the housing. One such configuration, which is particularly useful in marine operations, is the conical-funnel combination for the plug and housing as shown in the drawing.

After the plug is drawn into a seated position, the plug is disconnectably secured in place by means other than the flexible cable. A preferred method for securing the plug comprises a plurality of remotely controlled, hydraulically actuated pins 40 which pass through apertures in the walls of housing 32 to mating apertures 42 in the plug 30. Conventional hydraulic drivers 44 operated by control lines 46 leading from the drivers to control module 48 on the platform deck provide power for insertion or retraction of pins 40 into plug 30.

Ballasting and deballasting of this structure is accomplished by means of a compressed air supply 54, compressed air supply line 56 leading to the interior of buoyant leg 24, and remotely controlled, hydraulically actuated value 58. To admit seawater into buoyant leg 24, valve 58 is opened by control module 48 and air is admitted through line 56. To expel seawater from the buoyant leg, valve 58 is opened and compressed air is introduced into the chamber via line 56.

A remotely controlled thruster 60 is also provided to furnish power for moving the buoyant structure when necessary. In lieu of such a thruster, conventional auxiliary means such as tugs may be used.

When it is desired to move the structure from the path of an oncoming iceberg, tension is relieved in tendons 18 by admitting seawater into buoyant chambers 24. After the tension is sufficiently reduced to prevent undue strain on the flexible lines 26, hydraulic pins 40 are withdrawn from plug 30 and flexible lines 26 are payed out from reel 36. Thruster 60 is then powered and the unit may move within the scope of the line released. To return to the operating site, lines 26 are retrieved by the winch on reel 36 until plug 30 is seated. Hydraulic pins 40 are then used to secure plug 30 and the proper tension is applied to tendons 18 by expelling seawater from the buoyant chambers by the introduction of compressed air to the chamber legs.

I claim:

1. An improved tension leg platform having a floating buoyant structure anchored to the sea floor by a plurality of flexible tendons, the improvement comprising:

means for connecting flexible lines between said structure and said tendons and adjusting the length of said flexible lines to permit the structure to move substantially in a horizontal plane from the original anchor site; and means for moving said structure in a horizontal plane.

2. An improved tension leg platform of the type having a floating buoyant structure anchored to the sea floor by a plurality of flexible tendons, the improvement comprising:

means for disconnectably connecting said flexible tendons to the base of the structure; and a plurality of flexible lines extending from the structure, each having one end thereof attached to the upper end of a flexible tendon and each capable of adjustable extension to such a length to permit the structure to move substantially in a horizontal plane from the original anchor site.

3. An improved tension leg platform as recited in claim 2, wherein said flexible lines are stored in reels on the platform deck.

4. An improved tension leg platform as recited in claim 3, wherein the improvement further comprises:

means for moving said structure in a horizontal plane.

5. An improved tension leg platform of the type having a floating buoyant structure anchored to the sea floor by a plurality of flexible tendons attached to buoyant chamber legs, wherein the improvement comprises:

means for disconnectably connecting said flexible tendons to the buoyant chamber legs; and a plurality of flexible lines, each having one end thereof attached to the upper end of a flexible tendon, and each being capable of extending to a length sufficient to permit said structure to move substantially in a horizontal plane from the original anchor site, said lines passing downwardly from storage reels on a structure deck through guide conduits in the buoyant chamber legs in substantial vertical alignment with the point of attachment of the flexible tendons to said chamber legs.

6. An improved tension leg platform as recited in claim 5, further comprising:

means for ballasting and deballasting said buoyant structure; and means for moving said structure in a horizontal plane.

7. A method for moving a tension leg platform from the path of an oncoming iceberg comprising:

ballasting the structure to relieve the tension of the primary tendons;

disconnecting the primary means of attachment between said tendons in the structure; and paying out flexible lines connected between the structure and the tendons while the structure is moved.

8. A method for restoring a tension leg platform to its original operating site comprising:

retrieving flexible lines connected between the structure and the tendons;

connecting said tendons to the buoyant structure; and deballasting said structure to provide adequate tension in the tendons for operation.

* * * * *